US012029372B2

(12) United States Patent
Fawaz et al.

(10) Patent No.: US 12,029,372 B2
(45) Date of Patent: Jul. 9, 2024

(54) DETERGENT CARTRIDGE FOR A DISHWASHER

(71) Applicant: Midea Group Co., Ltd., Foshan (CN)

(72) Inventors: Bassam Fawaz, Louisville, KY (US); Robert M. Digman, Goshen, KY (US); Joel Boyer, Louisville, KY (US); Russell Dietrich, Taylorsville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 271 days.

(21) Appl. No.: 17/460,732

(22) Filed: Aug. 30, 2021

(65) Prior Publication Data

US 2021/0386269 A1 Dec. 16, 2021

Related U.S. Application Data

(63) Continuation of application No. 16/445,521, filed on Jun. 19, 2019, now Pat. No. 11,103,120.

(51) Int. Cl.

| | |
|---|---|
| ***A47L 15/44*** | (2006.01) |
| ***B65H 75/08*** | (2006.01) |
| ***B65H 75/28*** | (2006.01) |

(52) U.S. Cl.

CPC ..... *A47L 15/4463* (2013.01); *A47L 15/4472* (2013.01); *A47L 15/449* (2013.01); *B65H 75/08* (2013.01); *B65H 75/28* (2013.01); *A47L 2401/30* (2013.01); *A47L 2501/07* (2013.01)

(58) Field of Classification Search

CPC .. A47L 15/00–508; B65D 83/04–0481; B65G 2203/04–042; B65G 2203/047; B65H 75/28–285

See application file for complete search history.

(56) References Cited

U.S. PATENT DOCUMENTS 1,183,819 A * 5/1916 Keiser ..... B65H 75/28 242/586.5
2,951,656 A * 9/1960 Wellman ..... G03B 17/30 242/348.4
3,625,448 A * 12/1971 Griffiths ..... B21C 47/32 242/603

(Continued)

FOREIGN PATENT DOCUMENTS

DE 3908438 A1 9/1990
EP 3199930 A1 8/2017

(Continued)

OTHER PUBLICATIONS

Quantura, Dishwash & Rinse Aid Dosing System Kit (Including Install Kit), www.ttbsupplies.com, Retrieved on Feb. 8, 2019.

(Continued)

*Primary Examiner* — Spencer E. Bell
*Assistant Examiner* — Omair Chaudhri
(74) *Attorney, Agent, or Firm* — Gray Ice Higdon

(57) ABSTRACT

A detergent dispenser may be positioned to dispense detergent into a wash tub of a household appliance. The detergent dispenser may include a detergent cartridge. The detergent cartridge may include a detergent strip having a plurality of detergents. One or more ejection mechanisms may be used to expel the detergent from the detergent strip through an outlet of the detergent cartridge.

20 Claims, 6 Drawing Sheets

(56) References Cited

U.S. PATENT DOCUMENTS

| | | | | |
|---|---|---|---|---|
| 3,982,709 | A * | 9/1976 | Hertel | G03B 21/321 242/587.2 |
| 4,509,543 | A | 4/1985 | Livingston et al. | |
| 4,917,272 | A | 4/1990 | Ikeda | |
| 5,195,338 | A | 3/1993 | Russo | |
| 5,295,634 | A * | 3/1994 | Zander | G03B 17/30 242/584.1 |
| 6,065,708 | A * | 5/2000 | Matsubara | H02G 11/02 242/612 |
| 6,701,944 | B2 | 3/2004 | Mcnabb et al. | |
| 6,962,266 | B2 | 11/2005 | Morgan et al. | |
| 7,472,710 | B2 | 1/2009 | Jowett et al. | |
| 7,845,361 | B1 * | 12/2010 | Verespej | A47L 15/4418 68/17 R |
| 7,850,787 | B2 | 12/2010 | Buser | |
| 7,896,195 | B2 | 3/2011 | Limback et al. | |
| 8,221,696 | B2 | 7/2012 | Brandt et al. | |
| 8,329,112 | B2 | 12/2012 | Gibis et al. | |
| 8,651,336 | B2 | 2/2014 | Gadini et al. | |
| 8,980,014 | B2 | 3/2015 | Classen et al. | |
| 9,538,901 | B2 | 1/2017 | Van Tol et al. | |
| 10,238,267 | B2 | 3/2019 | Marone et al. | |
| 11,103,120 | B2 | 8/2021 | Fawaz et al. | |
| 2004/0065670 | A1 * | 4/2004 | Morgan | B65D 83/0472 221/33 |
| 2005/0236420 | A1 | 10/2005 | Jowett et al. | |
| 2005/0269346 | A1 | 12/2005 | Limback et al. | |
| 2005/0269348 | A1 * | 12/2005 | Limback | A47L 15/4409 221/263 |
| 2007/0114237 | A1 * | 5/2007 | Pirottavio | B65D 83/0472 221/25 |
| 2010/0018987 | A1 * | 1/2010 | Hamer | B65D 83/0454 221/56 |
| 2010/0071729 | A1 * | 3/2010 | Classen | A47L 15/4472 134/93 |
| 2011/0174346 | A1 | 7/2011 | Kessler et al. | |
| 2011/0247663 | A1 | 10/2011 | Gadini et al. | |
| 2011/0262318 | A1 | 10/2011 | Hofte et al. | |
| 2012/0247158 | A1 | 10/2012 | Ditze et al. | |
| 2013/0000781 | A1 | 1/2013 | Bischoff et al. | |
| 2013/0313352 | A1 * | 11/2013 | Alexandre | B65H 75/4471 242/388 |
| 2014/0263423 | A1 | 9/2014 | Akdogan et al. | |
| 2015/0294553 | A1 | 10/2015 | Logan et al. | |
| 2015/0359412 | A1 | 12/2015 | Delgado et al. | |
| 2016/0332842 | A1 * | 11/2016 | Hanson | B65H 75/285 |
| 2017/0037558 | A1 | 2/2017 | Dunsbergen et al. | |
| 2017/0231464 | A1 | 8/2017 | Kong et al. | |
| 2017/0269320 | A1 * | 9/2017 | Xu | B65H 75/28 |
| 2018/0293873 | A1 | 10/2018 | Liu et al. | |
| 2019/0003104 | A1 | 1/2019 | Shu et al. | |
| 2020/0079615 | A1 * | 3/2020 | Troxel | B65H 75/30 |
| 2020/0277725 | A1 * | 9/2020 | Caputo | B65G 43/00 |
| 2020/0397217 | A1 | 12/2020 | Fawaz et al. | |
| 2020/0397218 | A1 | 12/2020 | Fawaz et al. | |
| 2022/0259003 | A1 * | 8/2022 | Ha | B65H 75/4492 |

FOREIGN PATENT DOCUMENTS

| | | | | |
|---|---|---|---|---|
| EP | 3231346 | A2 | 10/2017 | |
| EP | 3305160 | A1 * | 4/2018 | A47L 15/4463 |
| EP | 3305160 | A1 | 4/2018 | |
| FR | 2940037 | B1 | 10/2011 | |
| GB | 2386129 | A | 9/2003 | |
| WO | WO2010142723 | A1 | 12/2010 | |
| WO | WO2013113576 | A1 | 8/2013 | |
| WO | WO2016034219 | A1 | 3/2016 | |

OTHER PUBLICATIONS

U.S. Patent and Trademark Office, Office Action issued in U.S. Appl. No. 16/445,521 dated Mar. 9, 2021.

Merriam-Webster. (n.d.). Cam. In Merriam-Webster.com dictionary. Retrieved Nov. 24, 2020, from https://www.merriam-webster.com/dictionary/cam (Year: 2020).

Merriam-Webster. (n.d.). Cartridge. In Merriam-Webster.com dictionary. Retrieved Nov. 24, 2020, from https://www.merriam-webster.com/dictionary/cartridge (Year: 2020).

Prime Studios, How to Load and Unload 35mm Film, Dec. 29, 2010, Youtube, https://www.youtube.com/watch?v=FjCfcTFP50E (Year: 2010).

U.S. Patent and Trademark Office, Notice of Allowance issued in U.S. Appl. No. 16/445,521 dated Jul. 27, 2021.

Chaudhri, Omair, United States Patent and Trademark Office, Notice of Allowance issued in U.S. Appl. No. 16/913,407, 30 pages, dated Oct. 3, 2022.

U.S. Patent and Trademark Office, Non-Final Office Action issued in U.S. Appl. No. 16/913,407 dated Apr. 25, 2022.

* cited by examiner

DETERGENT CARTRIDGE FOR A DISHWASHER

BACKGROUND

Dishwashers are used in many single-family and multi-family residential applications to clean dishes, silverware, cutlery, cups, glasses, pots, pans, etc. (collectively referred to herein as "utensils"). Most conventional dishwashers rely on a single-use detergent dispenser, often located on the interior of the door of the dishwasher. Such conventional dispensers include an opening allowing for a volume of liquid, powder, or dissolvable pod or capsule detergent to be loaded for a single wash. During a wash cycle such a dispenser is opened allowing the entirety of the contents of be expelled; as such, a user is required to reload the dispenser before each wash cycle is started. In certain instances, it may be desirable to minimize the number of times user is required to fill the detergent dispenser. A need therefore exists in the art for a multi-use dispenser.

SUMMARY

The herein-described embodiments address these and other problems associated with the art by providing a dishwasher using a multiple use detergent dispenser. In some embodiments of the invention, for example, a dishwasher may include a wash tub and a detergent dispenser positioned in the wash tub to dispense detergent into the wash tub. In various embodiments, the detergent dispenser may include a detergent cartridge including at least an outlet, a load compartment, an unload compartment having a spool wheel, and one or more cams positioned between the load compartment and the unload compartment adjacent the outlet configured to expel the detergent into the wash tub. In some embodiments, the detergent dispenser may include a spool wheel driver configured to rotate the spool wheel and progressively coil a detergent strip containing a plurality of the detergents into engagement with the one or more cams from the load compartment to the unload compartment thereby expelling the detergent from the detergent strip through the outlet.

In some embodiments, the one or more cams may include a lower cam and an upper cam projecting towards each other. In various embodiments, the detergent cartridge may include a base and a cover defining the unload compartment and the load compartment. Moreover, in some embodiments, the dishwasher may include a dishwasher door, wherein the dishwasher door includes a housing for receiving the detergent cartridge. In various embodiments, the dishwasher may include a break beam sensor adjacent an ejection window into the wash tub downstream of the outlet of the detergent cartridge. In some embodiments, the one or more cams may be stationary within the detergent cartridge. In addition, in various embodiments, the dishwasher may include a detergent strip having a plurality of detergents.

In some embodiments, a dishwasher may include a wash tub. In various embodiments, the dishwasher may include a dishwasher door defining the wash tub and provides external access to the dishwasher. In some embodiments, the dishwasher door includes a detergent dispenser to dispense detergent into the wash tub. In various embodiments, the detergent dispenser may include a compartment with a lid positioned in the dishwasher door, wherein the lid is positionable between an opened position and a closed position relative to the compartment. In some embodiments, the detergent dispenser may include a detergent cartridge. In various embodiments, the detergent cartridge may include an outlet, a spool wheel, one or more cams positioned adjacent the outlet configured to expel the detergent into the wash tub, and one or more detergent strips containing a plurality of the detergents. In some embodiments, the detergent dispenser may include a spool wheel driver configured to rotate the spool wheel and progressively coil the one or more detergent strips containing the plurality of the detergents into engagement with the one or more cams thereby expelling the detergent from the one or more detergent strips through the outlet.

In addition, in various embodiments, one of the compartment and/or the lid may include an ejection window. In some embodiments, the dishwasher may include a break beam sensor adjacent the ejection window downstream of the outlet of the detergent cartridge. In various embodiments, the spool wheel may be positioned in an unload compartment. In some embodiments, the detergent cartridge may include a cover and a base, wherein the cover may be positionable between an opened position and a closed position relative to the base. In various embodiments, an outer periphery of the detergent cartridge may include the outlet and the one or more cams may be positioned inwardly from the outlet. Moreover, in some embodiments, the spool wheel may include an attachment mechanism to secure an end of the one or more detergent strips. In various embodiments, the attachment mechanism may include an inner cylinder and an outer cylinder offset from each other and one or more slots in the outer cylinder.

In some embodiments, a detergent dispenser positioned to dispense detergent into a household appliance, may include a detergent cartridge having a plurality of detergents within one or more detergent strips. In various embodiments, the detergent cartridge may include at least one of a base and a cover defining an outlet, one or more cams adjacent the outlet, and a spool wheel. In some embodiments, the detergent dispenser may include a spool wheel driver configured to rotate the spool wheel and progressively coil the one or more detergent strips containing the plurality of detergents into engagement with the one or more cams thereby expelling the detergent from the one or more detergent strips through the outlet. In various embodiments, the detergent dispenser may include a housing configured to receive the detergent cartridge. Moreover, in some embodiments, the housing may include an ejection window.

In some embodiments, the household appliance may be a dishwasher and the housing may be coupled to a dishwasher door that provides external access to the dishwasher. In various embodiments, the detergent dispenser may include a break beam sensor adjacent the ejection window. Moreover, in some embodiments, the detergent cartridge may include a load compartment and an unload compartment with the one or more cams therebetween, and wherein the unload compartment includes the spool wheel. In various embodiments, the detergent cartridge may include a base and a cover, wherein the cover may be positionable between an opened position and a closed position relative to the base. In some embodiments, at least one of the base and the cover may be translucent.

These and other advantages and features, which characterize the invention, are set forth in the claims annexed hereto and forming a further part hereof. However, for a better understanding of the invention, and of the advantages and objectives attained through its use, reference should be made to the figures, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
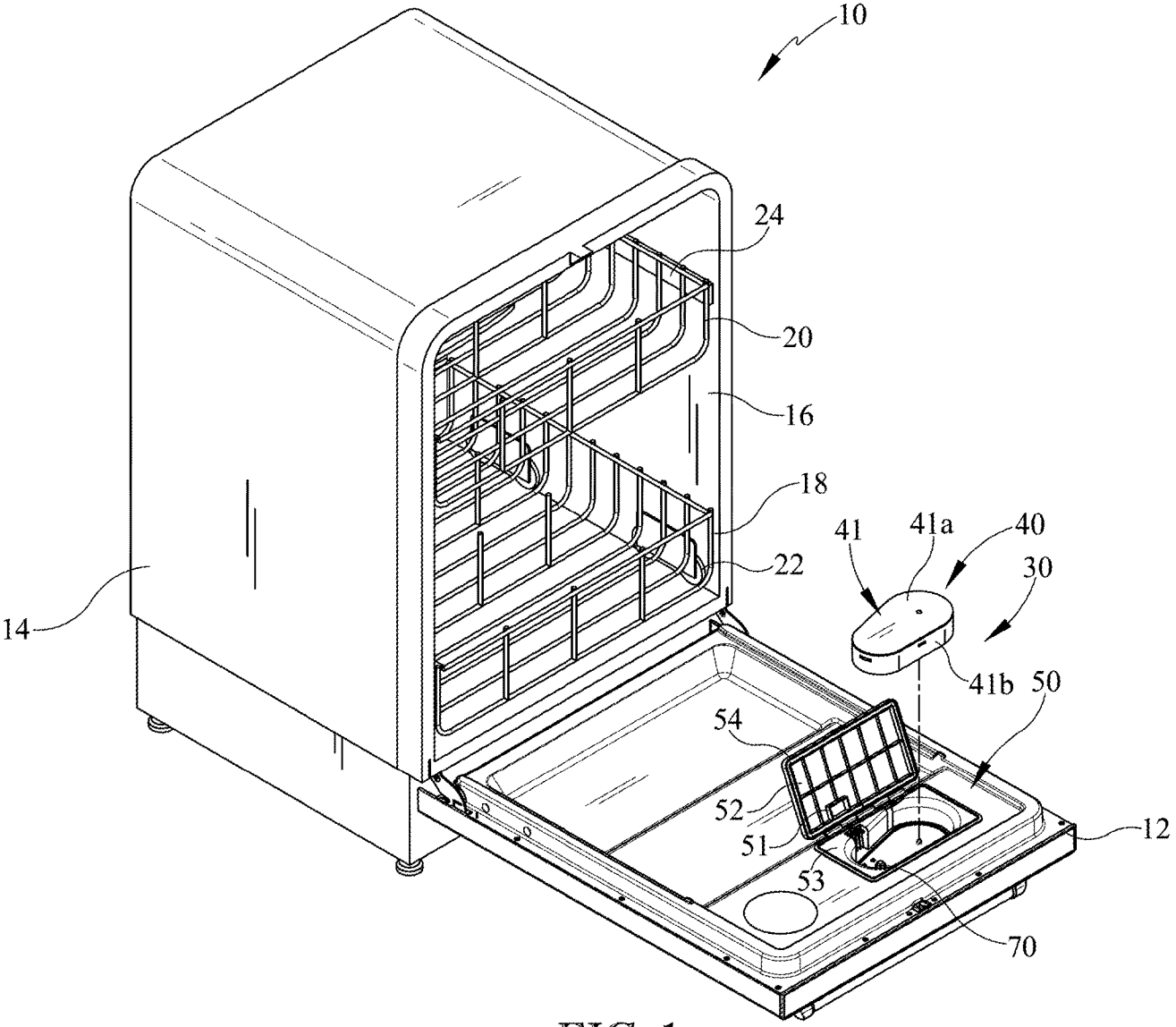
FIG. 1 is a perspective view of a dishwasher consistent with some embodiments of the invention illustrating an example detergent dispenser with a detergent cartridge exploded therefrom.

Turning now to the drawings, wherein like numbers denote like parts throughout the several views, FIG. 1 illustrates an example dishwasher 10 in which the various technologies and techniques described herein may be implemented. Dishwasher 10 is a residential-type built-in dishwasher, and as such includes a front-mounted door 12 that provides access to a wash tub 16 housed within the cabinet or housing 14. Door 12 is generally hinged along a bottom edge and is pivotable between the opened position illustrated in FIG. 1 and a closed position (not shown). When door 12 is in the opened position, access is provided to one or more sliding racks, e.g., lower rack 18 and upper rack 20, within which various utensils are placed for washing. Lower rack 18 may be supported on rollers 22, while upper rack 20 may be supported on side rails 24, and each rack is movable between loading (extended) and washing (retracted) positions along a substantially horizontal direction. Control over dishwasher 10 by a user is generally managed through a control panel (not shown in FIG. 1) typically disposed on a top or front of door 12, and it will be appreciated that in different dishwasher designs, the control panel may include various types of input and/or output devices, including various knobs, buttons, lights, switches, textual and/or graphical displays, touch screens, etc. through which a user may configure one or more settings and start and stop a wash cycle. Additionally, dishwasher 10 may include one or more rotating spray arms, e.g., lower spray arms, upper spray arm, or other sprayers, including various combinations of wall-mounted sprayers, rack-mounted sprayers, oscillating sprayers, fixed sprayers, rotating sprayers, focused sprayers, etc. However, this positioning is not intended to be limiting, as various sprayers may be positioned through the dishwasher.

In addition, consistent with some embodiments of the invention, dishwasher 10 may include a movable detergent dispenser 30 with multiple dishwashing cycles' worth of detergent 2 within the dispenser 30, so that it is not necessary for a user to add additional detergent before each dishwashing cycle. Such a detergent dispenser 30 may be positioned, as illustrated in FIG. 1, on the interior of the door 12. However, this positioning is not intended to be limiting, and in some embodiments the detergent dispenser may be positioned in other locations within the dishwasher (e.g. interior walls of wash tub 16) and still dispense detergent into the wash tub.

The embodiments discussed hereinafter will focus on the implementation of the hereinafter-described techniques within a hinged-door dishwasher. However, it will be appreciated that the herein-described techniques may also be used in connection with other types of dishwashers in some embodiments. For example, the herein-described techniques may be used in commercial applications in some embodiments. Moreover, at least some of the herein-described techniques may be used in connection with other dishwasher configurations, including dishwashers utilizing sliding drawers or dish sink dishwashers, e.g., a dishwasher integrated into a sink.

In some implementations, dishwasher 10 may be under the control of a controller that receives inputs from a number of components and drives a number of components in response thereto. Controller may for example, include one or more processors and a memory (not shown) within which may be stored program code for execution by the one or more processors. The memory may be embedded in controller, but may also be considered to include volatile and/or non-volatile memories, cache memories, flash memories, programmable read-only memories, read-only memories, etc., as well as memory storage physically located elsewhere from controller, e.g., in a mass storage device or on a remote computer interfaced with controller.

The controller may be interfaced with various components of the dishwasher 10, including an inlet valve that is coupled to a water source to introduce water into wash tub, which when combined with detergent, rinse agent and/or other additives, forms various wash fluids. Controller may also be coupled to a heater that heats fluids, a pump that recirculates wash fluid within the wash tub by pumping fluid to the wash arms and other spray devices in the dishwasher, an air supply that may provide a source of pressurized air for use in drying utensils in the dishwasher, a drain valve that is coupled to a drain to direct fluids out of the dishwasher, and a diverter that controls the routing of pumped fluid to different spray arms and/or other sprayers during a wash cycle.

The controller may also be coupled to the detergent dispenser 30 to trigger the dispensing of detergent into the wash tub at appropriate points during a wash cycle. More particularly, the controller may be coupled to a cartridge or drive mechanism 70 (e.g. spool wheel driver 71) of the detergent dispenser 30, which may include one or more micro switches or a stepper motor in order to control and/or determine the positioning of the various detergents of a detergent strip or coil 1 (discussed in greater detail herein). Additional sensors and actuators may also be used in some embodiments, including a temperature sensor to determine a wash fluid temperature, a door switch to determine when door 12 is latched, and a door lock to prevent the door from being opened during a wash cycle. If used, a break beam sensor or other suitable sensors 80 may be used to detect tablet ejection from the detergent dispenser 30, cartridge 40, etc. The tablet or detergent 2 dispensed from the detergent strip 1 may break the beam upon ejection. In some embodiments, if the ejection, spool wheel driver 71, or spool wheel 43 is timed the break beam sensor may not be used. For example, the detergent strip 1 may include a plurality of openings 4 or tracks to control placement and/or timing of the strip movement and corresponding ejection of the detergent 2 from the strip 1. Moreover, controller may be coupled to a user interface including various input/output devices such as knobs, dials, sliders, switches, buttons, lights, textual and/or graphics displays, touch screen displays, speakers, image capture devices, microphones, etc. for receiving input from and communicating with a user. In some embodiments, controller may also be coupled to one or more network interfaces, e.g., for interfacing with external devices via wired and/or wireless networks such as Ethernet, Bluetooth, NFC, cellular and other suitable networks.

Moreover, in some embodiments, at least a portion of controller may be implemented externally from a dishwasher, e.g., within a mobile device, a cloud computing environment, etc., such that at least a portion of the functionality described herein is implemented within the portion of the controller that is externally implemented. In some embodiments, controller may operate under the control of an operating system and may execute or otherwise rely upon various computer software applications, components, programs, objects, modules, data structures, etc. In addition, controller may also incorporate hardware logic to implement some or all of the functionality disclosed herein. Further, in some embodiments, the sequences of operations performed by controller to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the dishwasher 10 illustrated in FIGS. 1-6 will be apparent to one of ordinary skill in the art, as will become apparent from the description below. Therefore, the invention is not limited to the specific implementations discussed herein.

Figure 2:
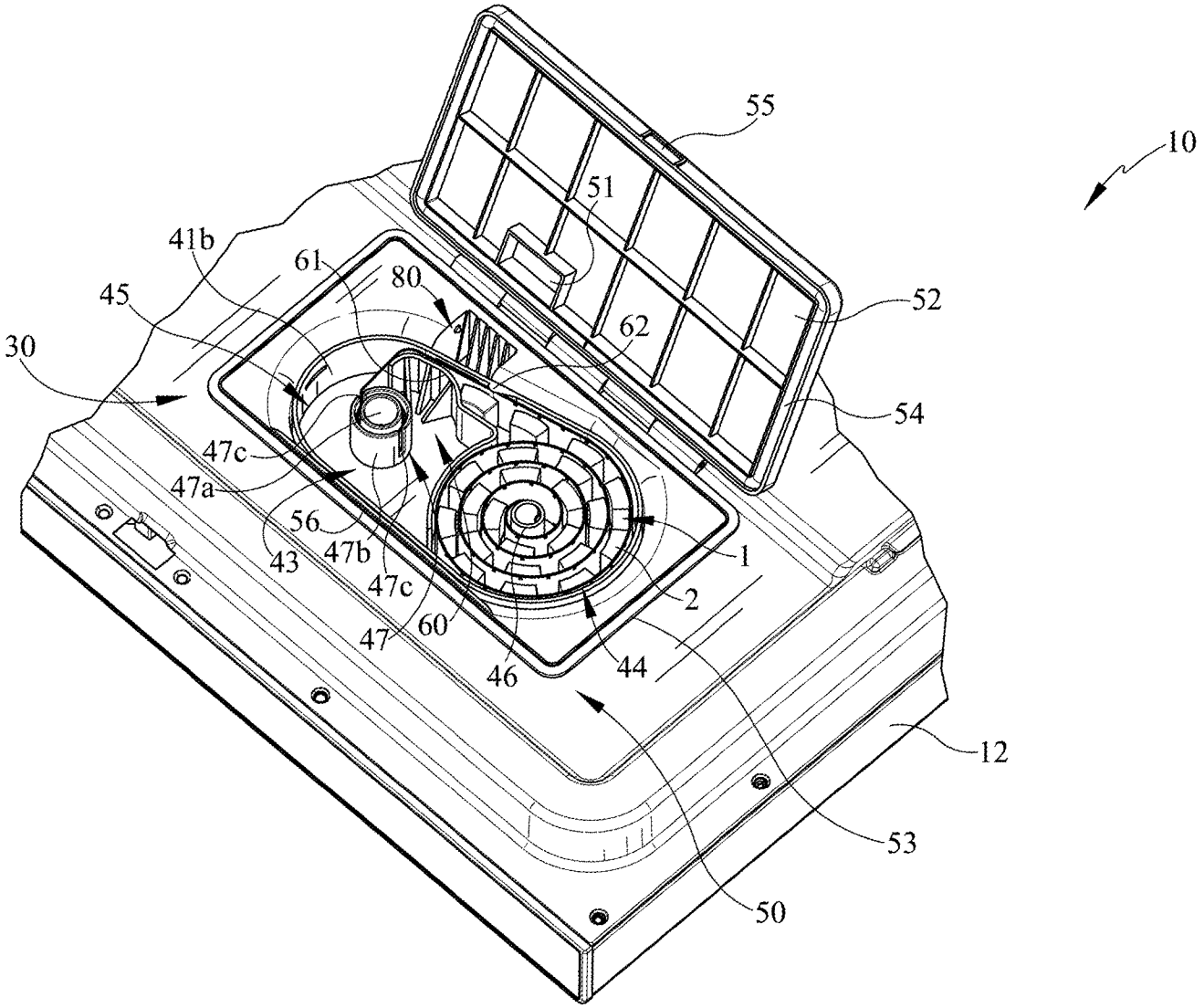
FIG. 2 is an enlarged top perspective view of the detergent cartridge disposed on the dishwasher door with a cover removed and a lid of a compartment in an opened position.
Figure 3:
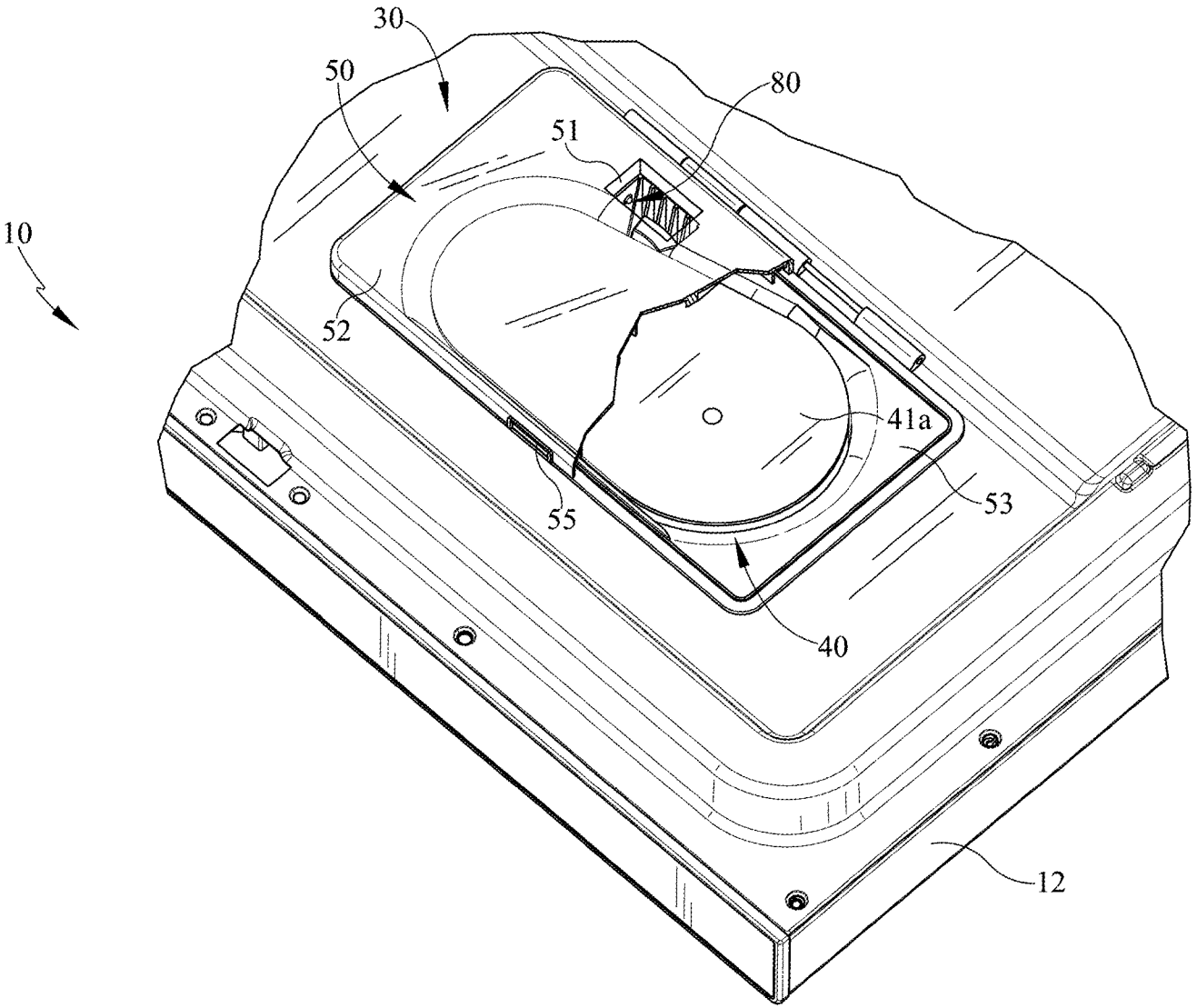
FIG. 3 is an enlarged top perspective view of the detergent cartridge with the cover disposed on the dishwasher door with the lid of a compartment in a closed position and partially broken away.

Now turning to the Figures, which illustrate an example detergent dispenser 30 in which the various technologies and techniques described herein may be implemented. In some embodiments, the detergent dispenser 30 may include a detergent cartridge 40 and/or a housing 50 (described in greater detailer below) for receiving the detergent cartridge. The detergent cartridge 40 may include a plurality of detergents 2 within one or more detergent strips 1, each blister 3 of the strip may be configured to hold a single wash cycle's worth of detergent. Each detergent cartridge may include one or more walls defining a housing 41; for example, as illustrated in FIGS. 3-6 the housing may have a cover 41*a* and a base 41*b*. The housing 41 and walls collectively define a cavity 41*c* having one or more outlets 42. Although the base 41*b* or outer periphery 41*d* (e.g. side wall extending between top and bottom walls) of the cartridge includes the outlet 42, at least one of the base or cover may include the outlet 42. As illustrated in FIGS. 1-3, the housing 50 is disposed so as to be easily accessible to a user when the door 12 of the dishwasher is open in order to facilitate the loading process of the cartridge 40; however, the dispensing or ejection window 51 is disposed so that when the door 12 of the dishwasher is closed the detergent 2 contained therein will drop into the proper location within the wash tub when in a dispensing position. In some embodiments, each detergent cartridge may additionally include an ejection mechanism 60 (e.g. one or more cams) used to eject the detergent into the proper location within the wash tub. In other embodiments, the dishwasher may spray water or other liquid into the ejection window 51 in order to wash the detergent from the housing 50 or cartridge 40.

In some embodiments, the detergent cartridge 40 may be removable from the housing 50 so that a user may load the cavity 41*c* with another detergent strip 1 or clean the detergent cartridge at a secondary location (e.g. a kitchen countertop, etc.). The cover 41*a* of the cartridge 40 may be opened (See FIG. 4) and a new or unused detergent strip may be installed and cover 41*a* subsequently closed with the base 41*b*. Once refilled, the cartridge may be returned to the housing 50. However, in other embodiments, the detergent cartridge 40, containing an emptied or used detergent strip, may be replaced by another cartridge 40 with a full or unused detergent strip.

Although not shown, each cartridge 40 may additionally include a seal or compression seal designed to minimize or prevent entry of water or other liquid into each of the one or more cavities 41*c* of the housing 41. In some instances, these seals may utilize compression forces in order to seal the cartridge. For example, the seal may be positioned between the cover 41*a* and the base 41*b*.

Each detergent cartridge may be configured to hold one or more detergent strips 1 with a plurality of detergents 2; this includes detergent of all varieties, including, but not limited to, liquid detergent, powder detergent, and/or dissolvable pod or capsule detergent. As illustrated in FIGS. 2-6, the detergent may be a dissolvable dishwashing pod/capsule/tablet within a blister 3 of the detergent strip 1. The clear blister packaging surrounding each detergent is not shown. One or more detergents may be dispensed for a variety of wash cycles.

In some implementations, the detergent cartridge 40 may include one or more compartments 44, 45 to configure the detergent strip 1 while expelling the detergent 2 therefrom. The cavity 41*c* may include one or more compartments having a variety of shapes, sizes, quantities, and constructions. The detergent strip 1 with detergents 2 may be in a coiled configuration within a first or load compartment 44 and configured or moved to a second or unload compartment 45 upon expelling the detergent 2 of a plurality of detergents 2 within the strip 1 or blister 3. The detergent strip 1 emptied by the ejection mechanism 60 may be progressively coiled into the unload compartment 45. A variety of drive mechanisms 70 may be used to progress the detergent strip 1 between compartments 44, 45 and/or into or out of engagement with the one or more ejection mechanisms 60. The load compartment 44 may be larger than the unload compartment 45 to receive the loaded detergent strip 1. Once the detergent is removed, the used or now-emptied detergent strip 1 without detergents may have a reduced volume and may be contained within the smaller downstream or unload compartment 45. The load compartment 44 may have a post or centering pin 46 to position the detergent strip 1 during operation. The unload compartment 45 may include the spool wheel 43. The spool wheel 43 may position the used detergent strip 1 during operation. The spool wheel 43, in the one embodiment shown, may rotate and progressively coil the used detergent strip 1 into the unload compartment 45.

Further, the spool wheel 43 may uncoil the detergent strip 1 from the load compartment 44 towards another or unload compartment 45. The spool wheel 43 and/or drive mechanism 70 progressively positions the blister 3 with detergent 2 or detergent strip 1 into engagement with the ejection mechanism 60 to expel the detergent from the detergent strip 1 through the outlet 42 of the detergent cartridge 40. The next cycle of operation, the detergent strip 1 may be repositioned or cycled to expel the next adjacent detergent 2 from the detergent strip 1 and/or to a position set to expel from the outlet 42 and/or ejection window 51.

In some implementations, the detergent cartridge 40 may include one or more ejection mechanisms 60 expelling the detergent 2 from the detergent strip 1 or blister 3 into the wash tub. In the one embodiment shown, the ejection mechanism 60 may be one or more cams 61, 62. The one or more cams 61, 62 may be adjacent the outlet 42 of the cartridge 40. The one or more cams 61, 62 may be stationary relative to the cartridge 40 and/or the detergent strip 1. As shown in the one embodiment, the one or more cams 61, 62 may be positioned between or proximate the load compartment 44 and the unload compartment 45. The first or upper cam 61 may be located near the cartridge outlet 42 and may be configured to engage the detergent 2/blister 3 of the detergent strip 1 (e.g. moving or translating strip) and remove the detergent 2 from the detergent strip 1. The now-emptied detergent strip 1 may be moved towards the unload compartment 45 or spool wheel 43. The first cam 61 may be positioned above the detergent strip 1 when the door 12 is in the closed position and forces/squeezes the detergent downwardly towards the outlet 42/ejection window 51 and through or out of the blister/strip. The first cam 61 may be spaced inwardly from the outlet 42 in the cartridge housing 41 or outer periphery. The first cam 61 may be arcuate in shape. The cam 61, 62 or portions defining the cavity 41*c* may narrow the pathway of the detergent strip 1 adjacent the outlet 42. In the one embodiment shown, a second or lower cam 62 may be used. The second cam 62, if used, may be positioned on an opposing side of the detergent strip 1 (e.g. adjacent the outer periphery 41*d*). The second cam 62 and the first cam 61 may project towards each other or towards the detergent strip. If used, the second cam 62 may be positioned upstream within the cavity 41*c* from the first cam 61. The second cam 62 may guide the detergent and/or strip into engagement with the first cam 61. Although not shown, a blade may be used to aid in the tearing/ejection of the blister, strip, or package. It should be understood that a variety of cam or ejection mechanisms may be used and still be within the scope of the invention. For example, in some embodiments, the cam or ejection mechanism may not be stationary. In addition, in some implementations, the spool wheel may include a plurality of cams on the outer periphery to eject the detergent from the detergent strip and/or cartridge outlet when rotating.

Figure 6:
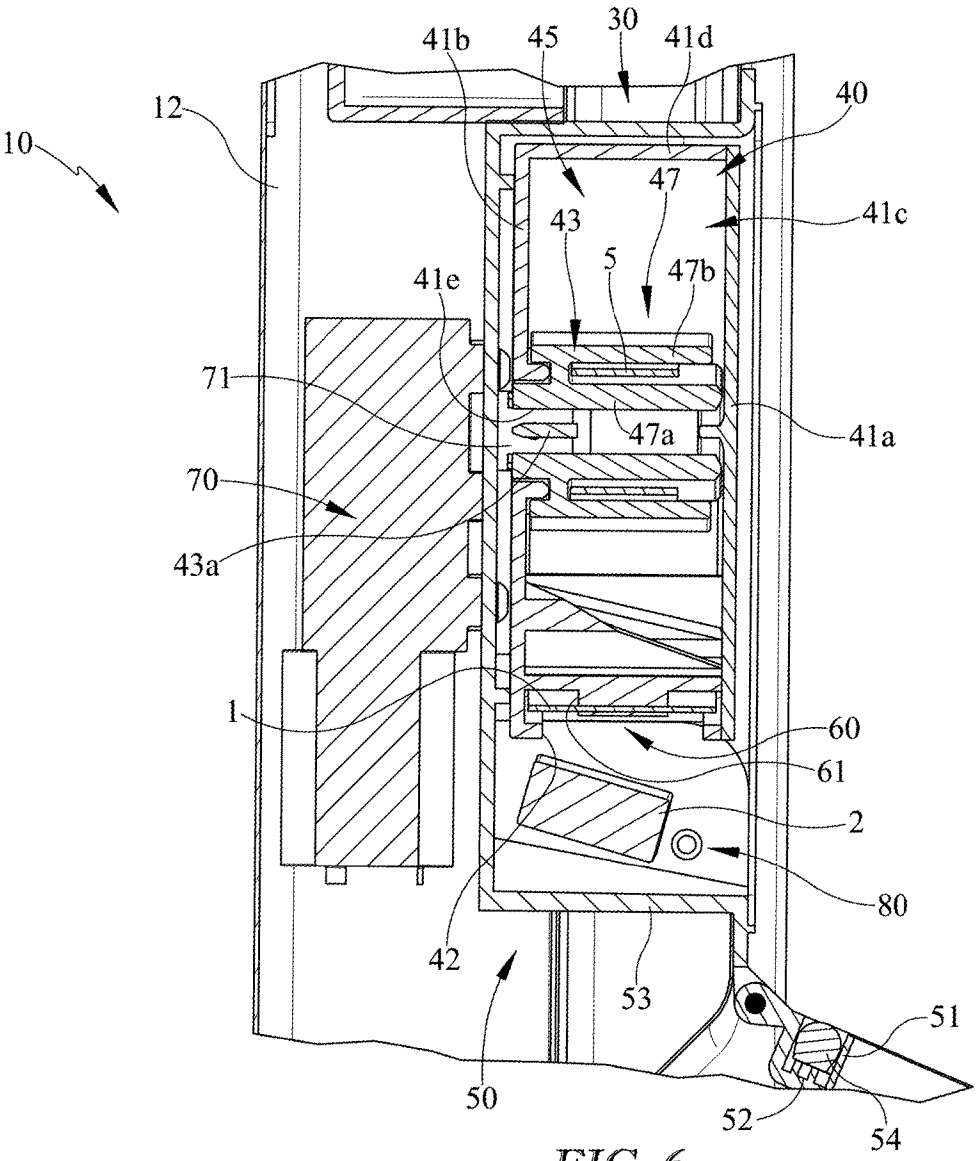
FIG. 6 is a sectional view of the example detergent dispenser taken along line 6-6 of FIG. 3.

The detergent dispenser 30 may include the drive mechanism 70 for moving the detergent strip 1 and/or spool wheel 43. One drive mechanism 70 shown is the spool wheel driver 71 for moving the detergent strip 1 and/or spool wheel 43 between multiple positions. For example, the detergent strip 1 may be capable of being moved to position at least one of the detergents 2 and/or blisters 3 near the outlet 42. The spool wheel 43 rotates via the driver 71 to force the detergent strip 1 into and/or out of engagement with the one or more cams 61, 62. The now-emptied detergent strip 1 may be coiled about the rotating spool wheel 43 and/or driver 71. When a particular detergent/blister is located near the outlet 42, the cam 61 urges the detergent out of the strip 1 so as to allow for dispensing of the detergent contained therein. Turning now to FIGS. 6-8, each of which illustrate a different view of the detergent dispenser 30. In some embodiments, the spool wheel driver 71 may be a rotating motor (e.g. DC motor) that rotates the spool wheel 43 between multiple positions, so that at any point during the rotation one of the detergents may be positioned near the outlet 42 and/or cam 61, 62. The spool wheel driver may be a motor that slides or coils the detergent strip (e.g. linearly) between multiple positions.

The spool wheel driver 71 (e.g. motor) may, in some embodiments, be positioned partially (as illustrated in FIG. 6) or wholly within an interior compartment 53 or housing 50 of the door 12 of the dishwasher. In some instances, such a position may be desirable as a way of saving space and minimizing the overall size of the detergent dispenser 30; such a position may also provide additional protection for the detergent cartridge 40 from water or other liquid. In other embodiments not shown, the spool wheel driver 71 may be disposed in the detergent cartridge 40, whereby the motor is removed or movable with the cartridge.

As shown in the Figures, the spool wheel driver 71 may extend or project from the compartment 53 of the detergent dispenser 30 or housing 50. The spool wheel driver 71 projects into the cartridge housing 41 or base 41*b* via an opening 41*e*/spool wheel 43 when the cartridge 40 is in the installed position. When the detergent cartridge is installed in the compartment 53, the spool wheel driver 71 may rotationally engage the spool wheel 43 (e.g. interfering ribs or teeth may engage each other between the driver and spool wheel). In the one embodiment shown, the rotational engagement may be radially extending interfering ribs 71*a*, 43*a*, respectively, between driver 71 and spool wheel 43. Rotation of the driver 71 and spool wheel 43 moves or progressively coils the detergent strip in increments thereon. The cartridge 40 and housing 50 (e.g. driver and spool wheel) wheel may engage each other in a variety of methods/constructions and still be within the scope of the invention.

In other embodiments not shown, the drive mechanism 70 may be a user-pretensioned spring (e.g. a clock spring) that may allow energy to be provided by a user and then be stored and used in order to change the linear or coil position of a detergent strip and/or rotation of the spool wheel. In such an embodiment, a user may "wind up" the pretensioned spring. A solenoid may then push a pawl in order to release a ratcheted segment to eject at least one detergent.

In some implementations, the spool wheel 43 may include one or more attachment mechanisms 47 engaging the detergent strip 1. The spool wheel 43 may include one or more attachment mechanisms 47 engaging a distal end 5 or a portion of the detergent strip 1. The attachment mechanism 47 secures the distal end 5 of the detergent strip land progressively coils the now-emptied detergent strip upon itself when the spool wheel driver 71 rotates the spool wheel 43. In the one embodiment shown, the attachment mechanism 47 may include an inner cylinder 47*a* and an outer cylinder 47*b* offset from each other about the rotational axis. The distal end 5 of the detergent coil may be looped and positioned in the radial space between the inner and outer cylinder 47*a*, 47*b*. From the distal or looped end 5, a portion of the detergent strip 1 extends from and passes through one or more slots 47*c* in the outer cylinder 47*b* towards the outlet and/or ejection mechanism. It should be understood that the attachment mechanism 47 may be a variety of quantities, shapes, sizes, and constructions and still interconnect the detergent strip to the spool wheel or drive mechanism. For example, although not shown, the spool wheel may include a plurality of teeth to mesh with openings 4 of the detergent strip to time or control the ejection of each detergent from the detergent strip.

As briefly described previously, a housing 50 may (removably or fixedly) receive the detergent cartridge 40. In some embodiments, the housing 50 may be a separate component of the detergent dispenser separable from the dishwasher 10 and/or the detergent cartridge 40; while in other embodiments, the housing 50 may be incorporated (e.g. by molding or the like) directly into the door 12 of the dishwasher 10. The housing 50 may additionally include a dispensing outlet or ejection window 51 configured to guide or direct the detergent contained in each detergent strip to the proper location within the washtub when dispensed.

Figure 4:
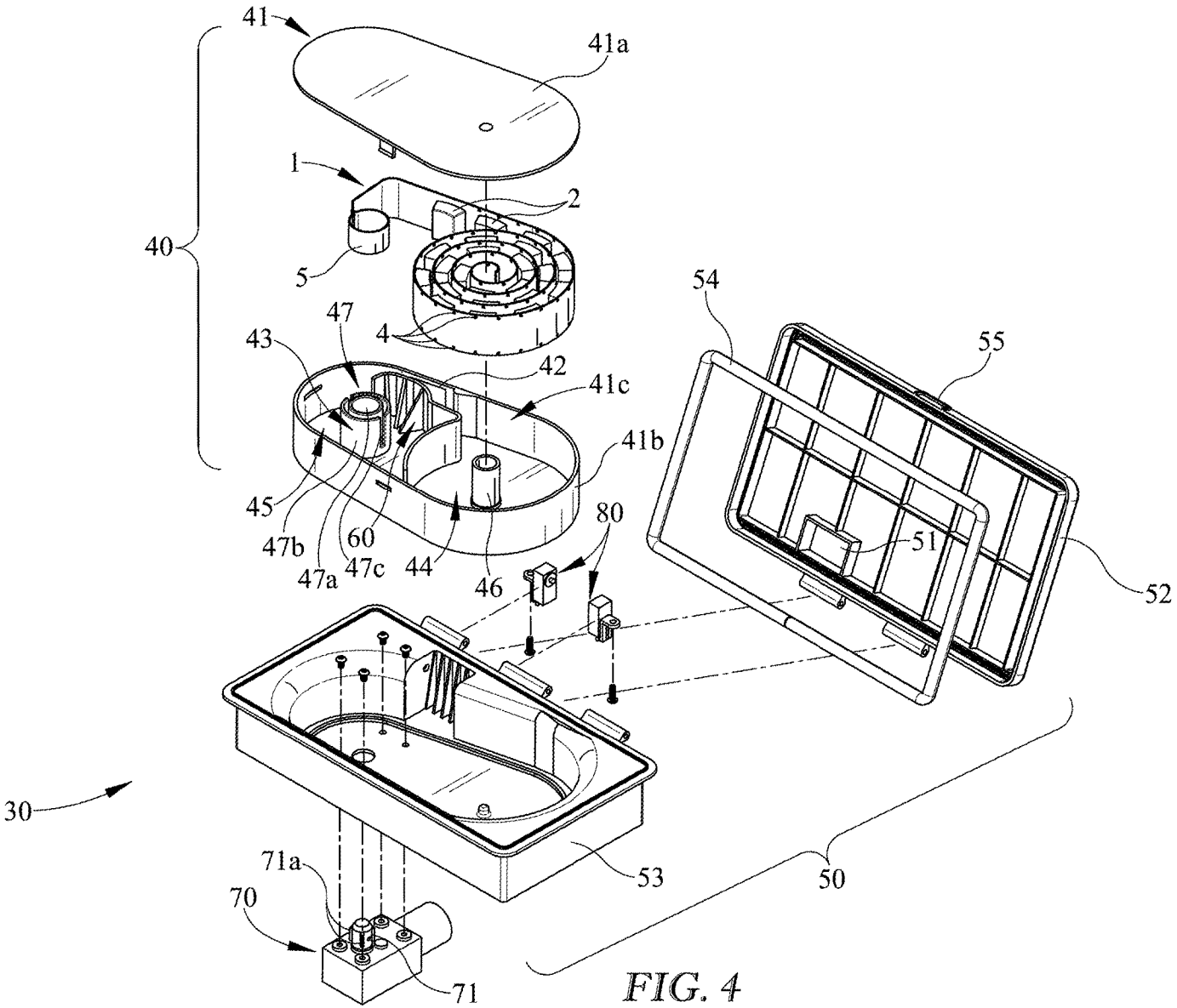
FIG. 4 is an exploded view of the embodiment detergent dispenser of FIG. 1.
Figure 5:
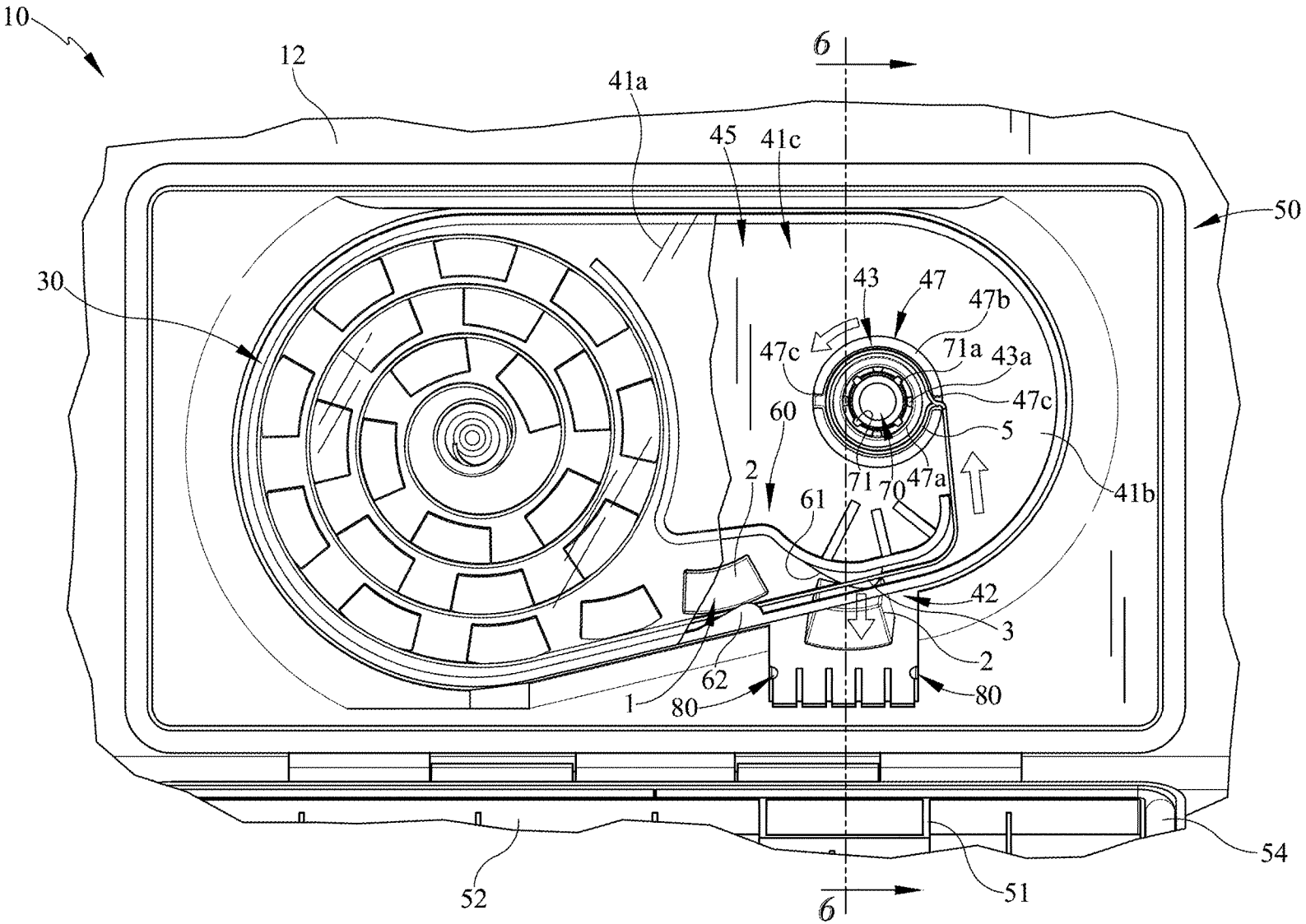
FIG. 5 is a side view of the example detergent dispenser of FIG. 1 disposed on the dishwasher door with the lid of the compartment in the opened position and the lid of the detergent cartridge partially broken away.

In some instances, the housing 50 and/or the detergent dispenser 30 may include a lid 52 positionable relative to a compartment 53. Such a lid 52 may be configured to seal the cavity or compartment 53 and minimize and/or prevent the entry of water or other liquid into the compartment/cartridge. In some instances, the lid 52 may use compression sealing or one or more seals 54, which may reduce friction while also ensuring that the compartment receiving the cartridge 40 is sealed. Additionally, the lid 52 may also include one or more latching protrusions 55 that are configured to be received by a corresponding receiver or void 56 of the housing 50 or compartment 53 in order to form a watertight seal. In some embodiments as shown, the lid 52 may be positioned or pivotable relative to the compartment 53 in an opened position (FIG. 1) to receive the cartridge 40 and a closed position (FIG. 3). The hinge or pivoting axis, if used, may be positioned adjacent the ejection window 51. The housing 50 or detergent dispenser 30 may include one or more ejection windows 51. As shown in the one embodiment, the lid 52 includes at least a portion of the ejection window 51. Alternatively, the compartment 53 and/or lid 52 may define the ejection window 51 in some embodiments. The detergent dispenser 30 and/or housing 50 may include the one or more break beam sensors 80 to detect the ejection of the detergent from the cartridge towards the wash tub. As shown in FIGS. 4-6, the break beam sensors 80 are positioned in the housing 50 or compartment 53 proximate the ejection window 51.

In some embodiments, the detergent dispenser 30 or portions thereof (e.g. lid 52 and/or cover 41*a*) may be constructed of a translucent material so that a user may be able to view the contents of the cartridge 40, detergent strip 1, and/or housing 50. As shown in FIG. 5, in some embodiments, the cover 41*a* may be translucent. In various other embodiments, the base 41*b* may be translucent. Moreover, in some embodiments as shown in FIG. 3, the lid 52 may be translucent. In other embodiments, the lid 52 and/or cover 41*a* may be any other color or opacity desired.

Although described herein with respect to a dishwasher, this is not intended to be limiting. The technology and techniques disclosed herein may be utilized in any household appliance that requires dispensing of a detergent, such as, for example a washing machine.

Various additional modifications may be made to the illustrated embodiments consistent with the invention. Therefore, the invention lies in the claims hereinafter appended.

What is claimed is:

1. A dishwasher comprising:
- a wash tub; and
- a detergent dispenser positioned in the wash tub to dispense detergent into the wash tub including
  - a detergent cartridge including:
    - an outlet;
    - a load compartment;
    - a detergent strip comprising a plurality of detergents;
    - an unload compartment having a spool wheel, wherein the spool wheel includes an inner cylinder and an outer cylinder fixed to and substantially concentric with the inner cylinder and offset from each other to define a continuous annular channel entirely around the inner cylinder and one or more slots in the outer cylinder securing an end of the one or more detergent strips;
  - a spool wheel driver configured to rotate both the inner cylinder and the outer cylinder of the spool wheel and progressively coil the detergent strip containing a plurality of the detergents from the load compartment to the unload compartment to expel at least one detergent of the plurality of detergents from the detergent strip through the outlet.

2. The dishwasher of claim 1 wherein the detergent cartridge includes one or more cams positioned between the load compartment and the unload compartment adjacent the outlet configured to expel the at least one detergent into the wash tub.

3. The dishwasher of claim 2 wherein the one or more cams is stationary within the detergent cartridge.

4. The dishwasher of claim 1 wherein the detergent cartridge includes a base and a cover defining the unload compartment and the load compartment, wherein the cover is configured between a closed position and an opened position relative to the base, and when the cover is in the closed position the cover closes a single end of the outer cylinder and the inner cylinder thereby closing a top portion of the one or more slots to engage the detergent strip to the spool wheel and when the cover is in the opened position the cover opens the single end of the outer cylinder and the inner cylinder thereby opening the top portion of the one or more slots to install and/or remove the detergent strip from the spool wheel.

5. The dishwasher of claim 1 further comprising a dishwasher door, wherein the dishwasher door includes a housing for receiving the detergent cartridge.

6. The dishwasher of claim 1 further comprising a break beam sensor adjacent an ejection window into the wash tub downstream of the outlet of the detergent cartridge.

7. The dishwasher of claim 1 wherein the end of the detergent strip is a closed looped end, and wherein the closed looped end is longitudinally positioned in a radial space defined by the annular channel between the inner cylinder and the outer cylinder with a portion of the detergent strip longitudinally positioned in the one or more slots and radially passing through the one or more slots in the outer cylinder.

8. A dishwasher comprising:
- a wash tub;
- a dishwasher door defining the wash tub and provides external access to the dishwasher, wherein the dishwasher door includes a detergent dispenser to dispense detergent into the wash tub including
  - a compartment with a lid positioned in the dishwasher door, wherein the lid is positionable between an opened position and a closed position relative to the compartment,
  - a detergent cartridge including:
    - an outlet;
    - a spool wheel, wherein the spool wheel includes an attachment mechanism to secure an end of one or more detergent strips, wherein the attachment mechanism includes an inner cylinder and an outer cylinder fixed to and substantially concentric with the inner cylinder and offset from each other to define a continuous annular channel entirely around the inner cylinder and one or more slots in the outer cylinder;

one or more cams positioned adjacent the outlet configured to expel the detergent into the wash tub;

the one or more detergent strips containing a plurality of the detergents;

a spool wheel driver configured to rotate both the inner cylinder and the outer cylinder fixed to the inner cylinder and progressively coil the one or more detergent strips containing the plurality of the detergents into engagement with the one or more cams thereby expelling the detergent from the one or more detergent strips through the outlet.

9. The dishwasher of claim 8 wherein at least one of the compartment and the lid includes an ejection window.

10. The dishwasher of claim 9 further comprising a break beam sensor adjacent the ejection window downstream of the outlet of the detergent cartridge.

11. The dishwasher of claim 8 wherein the spool wheel is positioned in an unload compartment.

12. The dishwasher of claim 8 the detergent cartridge includes a cover and a base, wherein the cover is positionable between an opened position and a closed position relative to the base.

13. The dishwasher of claim 8 wherein an outer periphery of the detergent cartridge includes the outlet and the one or more cams are positioned inwardly from the outlet.

14. The dishwasher of claim 8 wherein the end of the one or more detergent strips is looped, and wherein the looped end is positioned in a radial space defined by the annular channel between the inner cylinder and the outer cylinder with a portion of the one or more detergent strips passing through the one or more slots in the outer cylinder.

15. A detergent dispenser positioned to dispense detergent into a household appliance, comprising:

a detergent cartridge having a plurality of detergents within one or more detergent strips, including:

at least one of a base and/or a cover defining an outlet, and wherein the cover is positionable between an opened position and a closed position relative to the base;

one or more cams adjacent the outlet; and a spool wheel wherein the spool wheel includes an attachment mechanism to secure an end of the one or more detergent strips, wherein the attachment mechanism includes an inner cylinder and an outer cylinder fixed to and substantially concentric with the inner cylinder and offset from each other to define a continuous annular channel entirely around the inner cylinder and one or more slots in the outer cylinder;

a spool wheel driver configured to rotate both the inner cylinder and the outer cylinder of the spool wheel and progressively coil the one or more detergent strips containing the plurality of detergents to expel the detergent from the one or more detergent strips through the outlet; and a housing configured to receive the detergent cartridge, the housing including an ejection window.

16. The detergent dispenser of claim 15 wherein the household appliance is a dishwasher and the housing is coupled to a dishwasher door that provides external access to the dishwasher.

17. The detergent dispenser of claim 15 wherein the housing includes a break beam sensor adjacent the ejection window.

18. The detergent dispenser of claim 15 wherein the detergent cartridge includes a load compartment and an unload compartment with one or more cams therebetween, and wherein the unload compartment includes the spool wheel.

19. The detergent dispenser of claim 15 wherein at least one of the base and/or the cover is translucent.

20. The detergent dispenser of claim 15 wherein the end of the one or more detergent strips is a closed looped end, and wherein the closed looped end is longitudinally positioned in a radial space defined by the annular channel between the inner cylinder and the outer cylinder with a portion of the one or more detergent strips passing through the one or more slots in the outer cylinder.

* * * * *